US007432873B2

(12) United States Patent
Brachat et al.

(10) Patent No.: US 7,432,873 B2
(45) Date of Patent: Oct. 7, 2008

(54) MULTI-BAND PRINTED DIPOLE ANTENNA

(75) Inventors: Patrice Brachat, Nice (FR); Philippe Ratajczak, Nice (FR); Frédéric Devillers, Nice (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 11/888,756

(22) Filed: Aug. 2, 2007

(65) Prior Publication Data

US 2008/0030418 A1 Feb. 7, 2008

Related U.S. Application Data

(63) Continuation of application No. PCT/FR2006/050099, filed on Feb. 3, 2006.

(51) Int. Cl.
*H01Q 9/28* (2006.01)

(52) U.S. Cl. ..... 343/795; 343/810

(58) Field of Classification Search ..... 343/795, 343/810, 812, 813, 700 MS
See application file for complete search history.

(56) References Cited

U.S. PATENT DOCUMENTS 6,094,176 A 7/2000 Van Hoozen
6,281,849 B1 * 8/2001 Brachat ..... 343/700 MS
6,310,584 B1 * 10/2001 Reece et al. ..... 343/816
6,529,172 B2 * 3/2003 Zimmerman ..... 343/797
6,621,464 B1 9/2003 Fang
7,095,382 B2 * 8/2006 Surducan et al. ..... 343/793

FOREIGN PATENT DOCUMENTS

FR 2713020 2/1996
WO WO 2004/019445 A2 3/2004

OTHER PUBLICATIONS

"T-Dipole Arrays for Mobile Applications" by Christian Sabatier, IEEE Antennas and Propagation Magazine, vol. 45, No. 6, Dec. 2003, pp. 9-24.

* cited by examiner

*Primary Examiner*—Hoang V Nguyen
(74) *Attorney, Agent, or Firm*—Lawrence E Laubscher, Sr; Lawrence E Laubscher, Jr

(57) ABSTRACT

The invention relates to a printed antenna comprising a dielectric substrate (CS1, CS2) supporting feeder lines (LA1, LA2) and first and second T-shaped dipoles (D1, D2) of different sizes for dual-band operation. Each dipole includes a stem (J1, J2) and two radiating arms (B1, B2) separated by a coupling slot (FC1, FC2) made in the stem. For compactness of the antenna, the stems are partly superimposed, the coupling slots are aligned and a decoupling cut-out (ED) is made in the second dipole so as to uncover the coupling slot of the first dipole, by virtue of their superposition. The substrate can comprise one, two or three layers. Plural antennas can constitute an antenna network used as a base element in one-dimensional or two-dimensional network.

9 Claims, 6 Drawing Sheets

MULTI-BAND PRINTED DIPOLE ANTENNA

CROSS REFERENCE TO RELATED APPLICATIONS

This application is a continuation of the PCT International Application No. PCT/FR2006/050099 filed Feb. 3, 2006, which is based on the French Application No. 0501814 filed Feb. 18, 2005.

BACKGROUND OF THE INVENTION

1. Field of the Invention

The present invention relates to a multi-band printed dipole antenna for a telecommunication signal receiving and/or sending network, capable of radiating radio-frequency fields in a plurality of frequency bands.

Such an antenna is intended to function in a first frequency band of a cellular radio communication network conforming to the DCS-1800 standard and/or of the CDMA type and in a second frequency band for a cellular radio communication system conforming to the GSM-900 standard, for example. The invention may equally be applied to the field of measurement probes.

2. Description of Related Art

According to the French patent 2 713 020 and the article entitled "T Dipole Arrays for Mobile Applications" by Christian Sabatier, IEEE Antennas and Propagation Magazine, Vol. 45, No. 6, December 2003, pages 9 to 26, a printed antenna comprises a T-shaped conductive element that extends on the upper portion of a dielectric substrate and that has an axial slot separating two radiating arms of the T-shape. The conductive element is fed by a coaxial feeder line extending on the lower face of the substrate. This dipole utilizes the double stub adaptation principle and a wide frequency band.

There are also known multi-band antennas that associate by coupling supplementary arms in the same plane as a principal arm.

Other types of multi-band operation can be achieved by the introduction of localized element filters, by feeding a plurality of dipoles in series, or by deformation of a principal arm.

The antenna described in the patent and the article referred to above offers operation only in one frequency band and all the solutions referred to above have the drawback of narrow-band multi-frequency operation.

An object of the present invention is to design a compact multi-band printed dipole antenna operating in at least two frequency bands.

SUMMARY OF THE INVENTION

A multi-band printed dipole antenna according to the invention comprises first and second dipoles supported by a dielectric substrate and each having, in a manner known from the French patent 2 713 020, a T-shaped conductive element including a stem and two radiating arms separated by a coupling slot made in the stem, and a feeder line that can for the most part extend parallel to the stem.

The invention improves a printed dipole antenna structure with single-band operation through the presence of a second dipole the stem and the arms whereof are respectively longer than the stem and the arms of the first dipole.

The antenna according to the invention is characterized by a superposition of the stem of the first dipole and a base of the stem of the second dipole, an alignment of the coupling slots, and a decoupling cut-out made in the stem of the second dipole and into which the coupling slot of the first dipole opens by superposition. The cut-out made in the second dipole preferably has a far side substantially aligned with the slot of the first dipole.

Thanks to the above features, the antenna according to the invention is very compact at the same time as offering operation in different frequency bands. The antenna can achieve a standing wave ratio less than 2 over more than 50% of the bandwidth in each of the bands. For example, the first dipole radiates in the frequency bands of DCS-1800, UMTS and WLAN networks and the second dipole in the frequency band of the GSM-900 network. The antenna according to the invention retains the bandwidth performance of the antenna known from the French patent 2 713 020 and offers a considerable saving in space thanks to the superposition of the two dipoles, the thickness of the antenna being negligible compared to the length or the width thereof.

In a first embodiment offering high decoupling between the dipoles, the decoupling cut-out completely uncovers the coupling slot of the first dipole, by virtue of their superposition, the dielectric substrate comprises two dielectric layers and the feeder lines of the dipoles extend between facing faces of the two dielectric layers, or the dielectric substrate comprises a dielectric layer for each dipole having faces respectively supporting the feeder line and the conductive element of the dipole, and a dielectric layer extending between the layers supporting the dipoles.

According to another embodiment, the conductive elements of the dipoles extend on a common face of the dielectric substrate, the stem of the first dipole and the base of the stem of the second dipole being coincident, and the feeder lines extend on the other face of the dielectric substrate. This embodiment has the advantage of featuring a single substrate, which procures a saving of space and a smaller overall size. For these embodiments, a metallic plane can extend perpendicularly to the faces of the substrate, the dipole having the arms farthest from the metallic plane operating at the lowest frequencies.

The invention relates also to an array of antennas comprising a plurality of antennas, each printed antenna being supported by a dielectric substrate and comprising first and second dipoles each having a T-shaped conductive element including a stem and two radiating arms separated by a coupling slot made in the stem, and a feeder line, the stem and the arms of the second dipole being respectively longer than the stem and the arms of the first dipole.

The array is characterized in that in each antenna, the stem of the first dipole and a base of the stem of the second dipole are superposed, the coupling slots are aligned, and a decoupling cut-out is made in the stem of the second dipole and the coupling slot of the first dipole opens by superposition into the decoupling cut-out, and the faces of the substrates of the antennas are parallel to each other and the coupling slots of the dipoles are oriented in a parallel manner.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

A two-band printed dipole antenna according to the first embodiment of the invention is described in detail hereinafter with reference to FIGS. 1 to 5.

The antenna comprises two stacked rectangular dielectric substrate layers CS1 and CS2 and two superposed printed dipoles D1 and D2. The dipoles radiate in different frequency bands BF1 and BF2 and therefore have different dimensions. The smaller first dipole D1 is on the lower face of the first layer CS1 and is adapted to radiate in a first frequency band BF1 from about 1.5 GHz to about 2.5 GHz, for example, in order to cover a band combining the DCS-1800, UMTS and WLAN bands. The second dipole D2 extends on the upper face of the second layer CS2 and is adapted to radiate in a second frequency band BF2 that is below the first frequency band BF1 and lies between about 0.7 GHz and about 1.0 GHz, for example, to cover the GSM-900 band. A printed feeder line LA1 with integral diplexer feeds the first dipole D1 and a printed feeder line LA2 with integrated diplexer feeds the second dipole D2. The feeder lines LA1 and LA2 extend between the facing faces of the first and second dielectric layers CS1 and CS2. Thus the facing faces of the dielectric layers are the faces opposite the faces on which the dipoles lie, and all the faces of the layers are parallel to each other. The layers CS1 and CS2 consist of a Duroid substrate, for example, with a relative dielectric permittivity of 2.2 and a thickness of about 0.75 mm. Alternatively, the layers CS1 and CS2 consist of substrates with different relative dielectric permittivities and/or different thicknesses.

Figure 1:
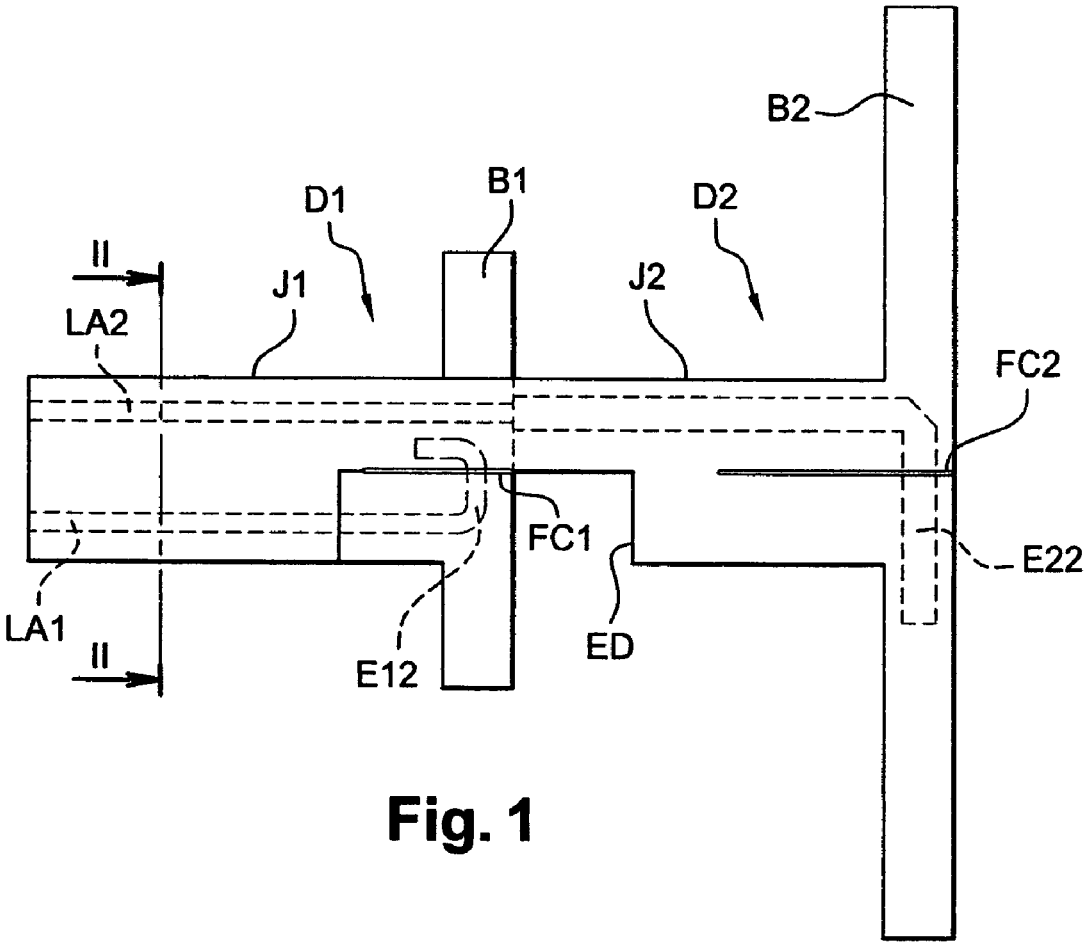
FIG. 1 is a plan view of the two-band printed dipole antenna according to a first embodiment of the invention.
Figure 2:
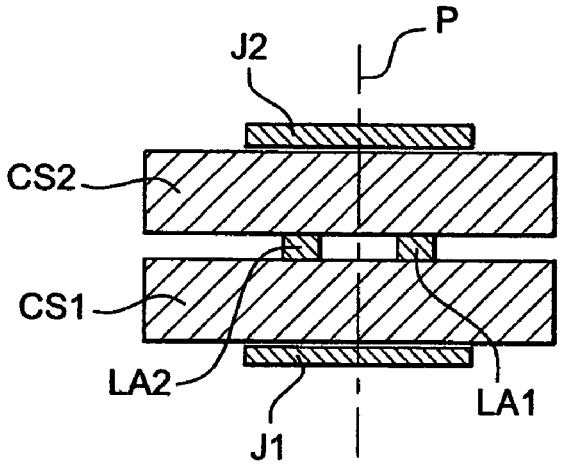
FIG. 2 is a section taken along the line II-II in FIG. 1.
Figure 3:
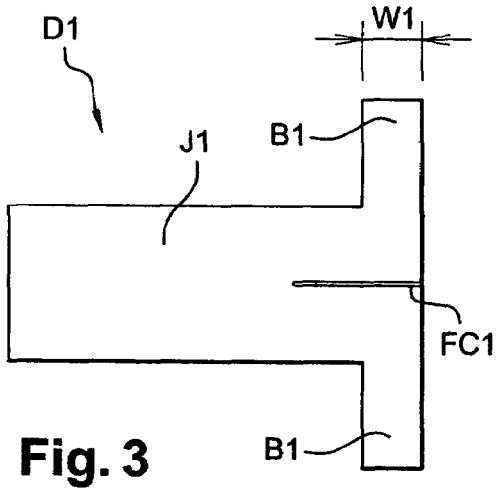
FIGS. 3 and 4 are plan views of first and second dipoles of the antenna according to the first embodiment.
Figure 4:
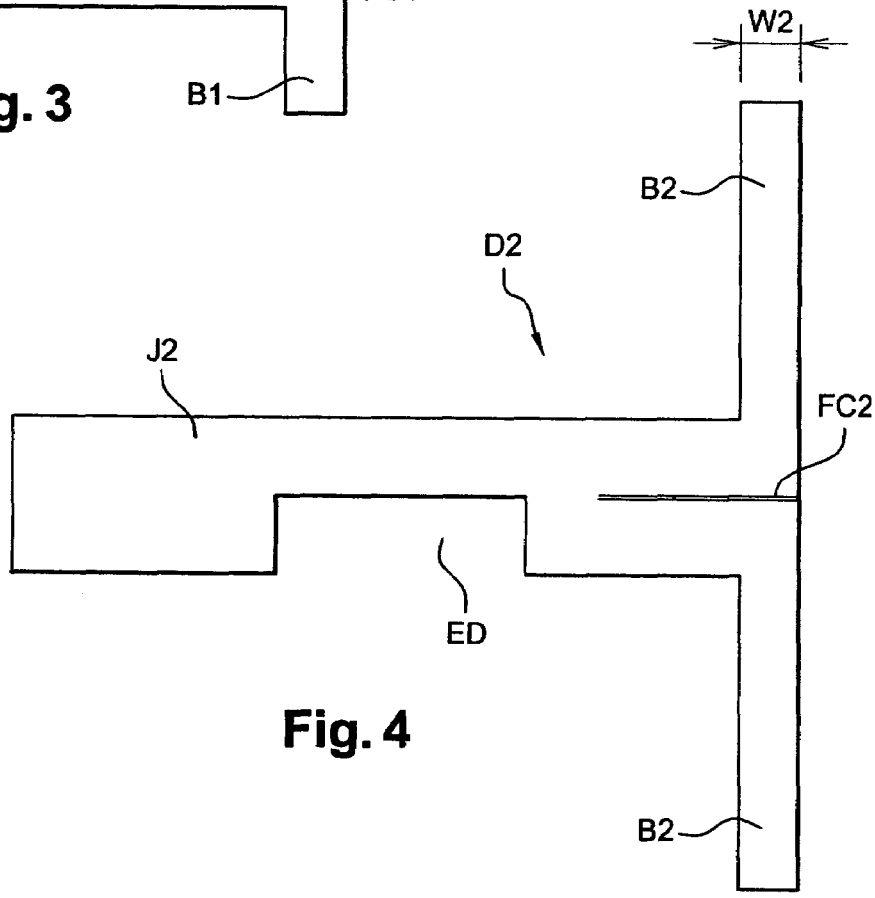
Figure 5:
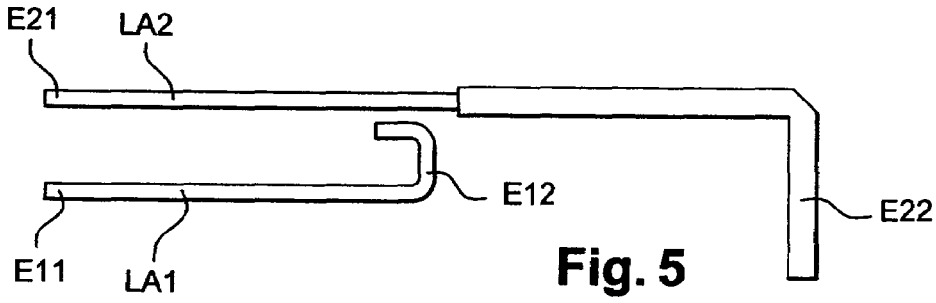
FIG. 5 is a plan view of the feeder lines of the antenna according to the first embodiment.

As shown in FIG. 1, each dipole D1, D2 comprises a flat T-shaped conductive element comprising a stem J1, J2 and two lateral arms B1, B2 consisting of the branches of the T-shape perpendicular to the stem and separated by a coupling slot FC1, FC2 formed axially at the summit of the stem. The stem J1, J2 constitutes a ground plane for the corresponding feeder line LA1, LA2. The edges of the bases of the stems J1 and J2 are coplanar in a plane perpendicular to the layers, and the arms B2 of the larger dipole D2 are situated in front of the arms B1 of the smaller dipole D2 in the radiation direction. The stems have identical widths and collinear edges in plan view, for example, as shown in FIGS. 1 and 2, the longer stem J2 covering the shorter stem J1 in order to make the antenna very compact. The lateral arms B1, B2 constitute the radiating portion of the conductive element. The coupling slots FC1 and FC2 are preferably of rectangular shape and very narrow, for example having a width of 0.5 mm.

The lateral arms B1, B2 of each dipole D1, D2 preferably have identical lengths. The sum of the lengths of the arms is substantially equal to half the wavelength corresponding to the center frequency of the operating band of each dipole. As the center frequency of the first band BF1 is higher than the center frequency of the second band BF2, the arms B1 of the first dipole D1 are shorter than the arms B2 of the second dipole D2. Similarly, the length of the stem J1, J2 is equal to approximately half said wavelength, although this length of the stem is less critical because it does not make a dominating contribution to the radiation from the antenna. The width of the stems J1, J2 is substantially twice the width W1, W2 of the lateral arms B1, B2, for example, so that the stems cover the longitudinal feeder lines LA1 and LA2 between the stems. The feeder lines LA1 and LA2 are parallel to the stems of the dipoles D1 and D2 and are printed with the dipoles using the triplate technology for which the stems J1 and J2 serve as ground plane.

The feeder line LA1 of the first dipole D1 on the stem J1 extends between an access end E11 and a U-shaped end E12, symmetrically to the line LA2 with respect to an axial longitudinal plane P of the antenna common to the stems and to the coupling slots. The access end E11 is situated at the edge of the antenna and is connected by a connector to a first microwave signal generator for the band BF1. The U-shaped end E12 has a core crossing the coupling slot FC1 perpendicularly by virtue of their superposition and situated axially under the origin of the arms B1, and is terminated by a short terminal branch substantially parallel to the coupling slot FC1 and in the vicinity of the feeder line LA2. The end E12 is bent in a U-shape toward the feeder line LA2 of the second dipole in order to keep the antenna very compact by avoiding moving apart the juxtaposed parallel feeder lines LA1 and LA2 between the dielectric layers CS1 and CS2 and therefore widening the stems J1 and J2, at the same time as ensuring effective excitation of the arm B1 over which the other feeder line LA2 passes and therefore of the two quarter-wave arms B1 coupled by a slotted line FC1. The length of the coupling slot FC1 and the dimensions of the U-shaped end E12 of the feeder line LA1 are chosen to adapt the dipole D1 to a wide band BF1.

The feeder line LA2 of the second dipole D2 extends under the stem J2 between an access end E21 and an end E22 bent at a right angle, symmetrically to the line LA1. The access end E21 is situated at the edge of the antenna and is connected by a connector to a second microwave signal generator for the band BF2. The U-shaped end E22 is terminated by a short rectilinear section situated axially under the origin of the arms B2, and crossing the coupling slot FC2 perpendicularly by virtue of their superposition so as also to lie under the arm B2 on the same side of the axial longitudinal plane P of the antenna, and thereby to excite the two radiating arms B2 as quarter-wave stubs coupled by a slotted line FC2.

A decoupling cut-out ED, which is rectangular, for example, is provided in the stem J2 of the second dipole D2 (FIG. 4) lying over the leg J1 of the first dipole D1 and beyond the summit of the stem J1 including the coupling slot F1 of the first dipole D1. The cut-out ED is made in the edge of the stem J2 of the second dipole D2 closer to the feeder line LA1 and uncovers a portion of the line end E12 from the coupling slot FC1, and substantially uncovers the coupling slot FC1 itself. The cut-out ED preferably uncovers the coupling slot FC1 completely by virtue of their superposition and has a far side that is situated substantially in a plane perpendicular to the dielectric layers and containing the side of the coupling slot FC1 that is closest to the other feeder line LA2. Thus a projection of the coupling slot FC1 of the first dipole D1 onto the plane of the second dipole D2 is contained within the decoupling cut-out ED. The decoupling cut-out ED decouples the ground plane consisting of the stem J2 of the second dipole D2 from the coupling slot FC1 of the arms B1 of the first dipole D1 in order for the latter to be able to radiate.

The printed dipole antenna according to the first embodiment of the invention combines compactly two superposed and decoupled printed dipoles D1 and D2 operating in the frequency bands BF1 and BF2, respectively, in accordance with the double stub adaptation principle. The printed dipole antenna typically has a maximum length of about 150 mm and a maximum width of about 150 mm, preferably in accordance with a square shape, and has a thickness of approximately 1.5 mm to offer a minimum overall size.

Measurements have shown that the printed dipole antenna described hereinabove offered a standing wave ratio less than 2 over more than 50% of the bandwidth in each of the two frequency bands BF1 and BF2, and guaranteed a decoupling level better than −20 dB between the access end E21 for the band BF1 (GSM) and the access end E11 for the band BF2 (DCS+UMTS+WLAN).

Figure 6:
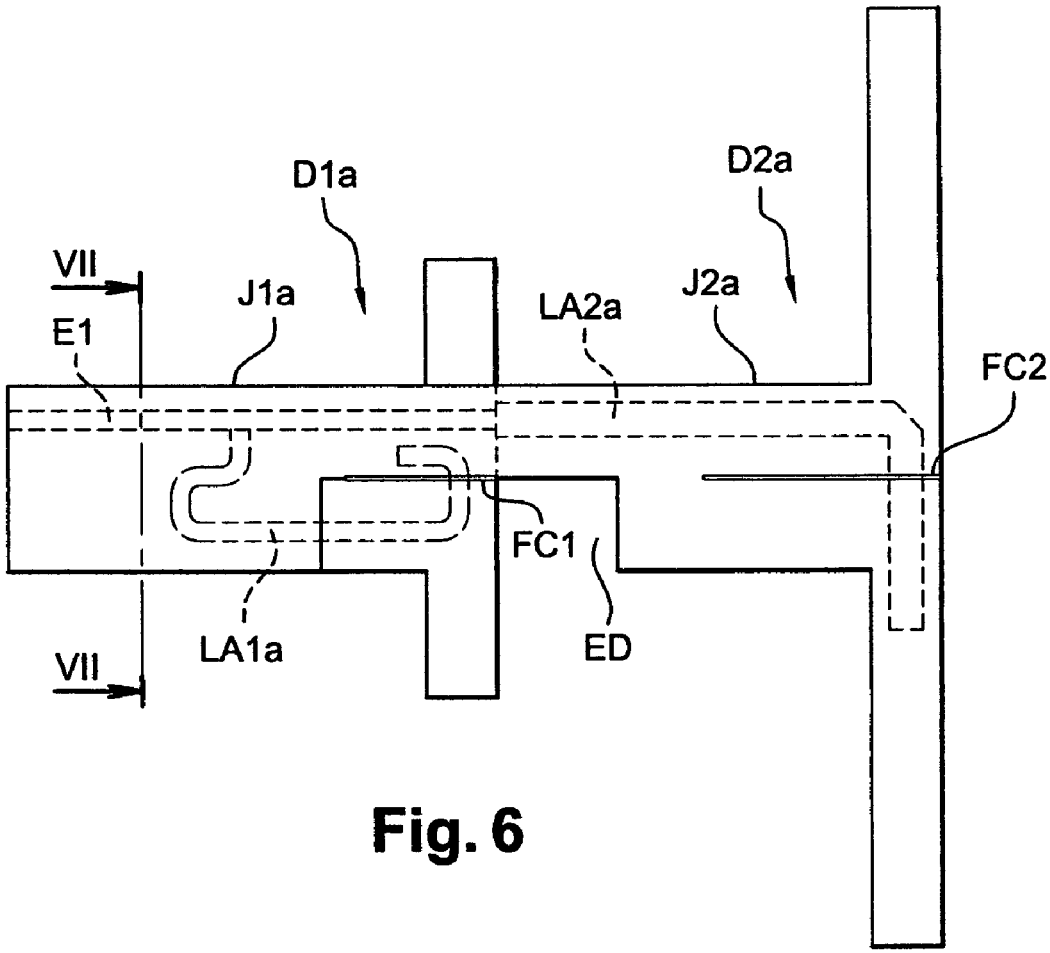
FIG. 6 is a plan view of the antenna with common access feeder lines according to a variant of the first embodiment.
Figure 7:
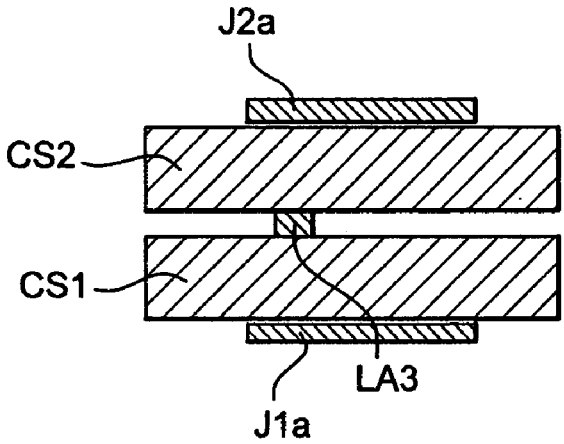
FIG. 7 is a section taken along the line VII-VII in FIG. 6.

According to a variant of the first embodiment, and in an analogous manner to FIGS. 1 to 5, the feeder lines LA1*a* and LA2*a* of the dipoles D1*a* and D2*a* of the antenna have a common access end E1, as shown in FIGS. 6 and 7. For example, the common access end E1 situated between the bases of the stems J1*a*, J2*a* of the dipoles D1*a*, D2*a* is colinear with one feeder line LA2*a* and the other feeder line LA1*a* has a sinuous end to circumvent the far side of the decoupling slot FC1*a*.

Figure 8:
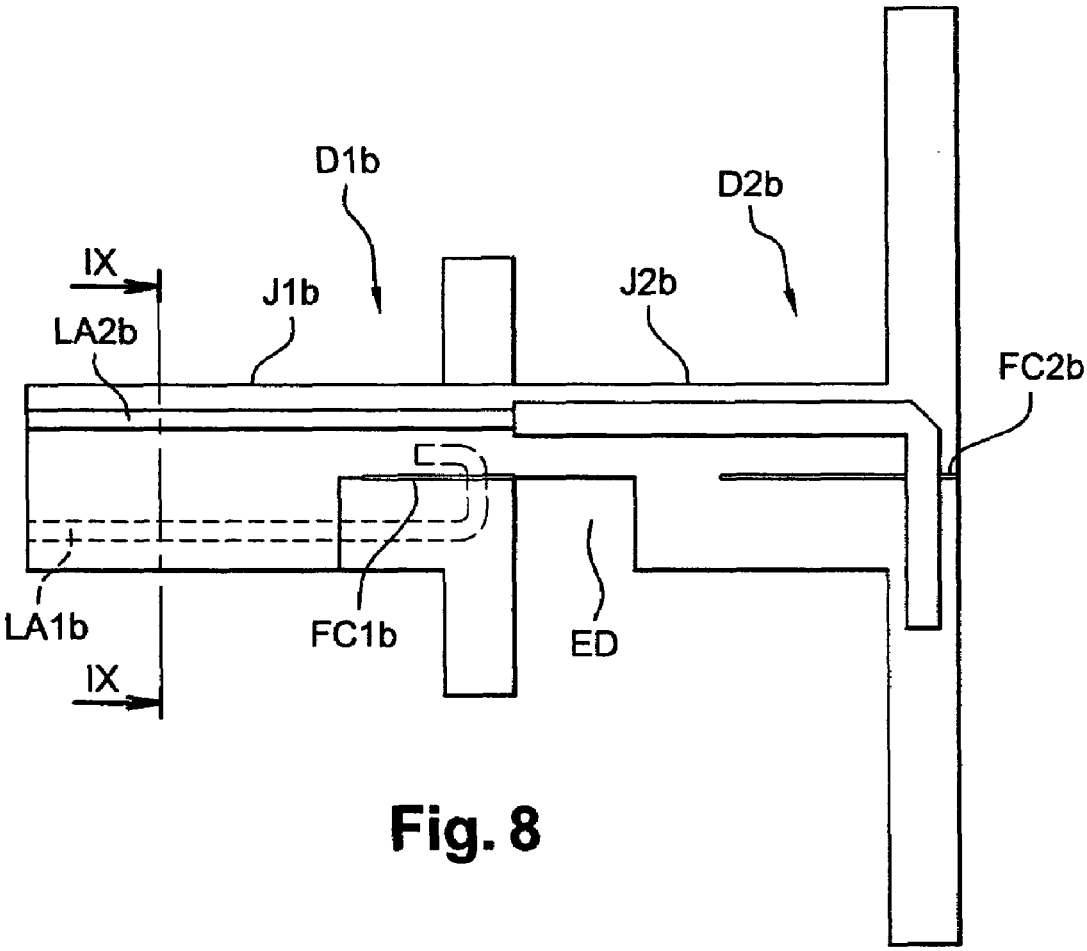
FIG. 8 is a plan view of the antenna with feeder lines on separate dielectric layers in accordance with a second embodiment of the invention.
Figure 9:
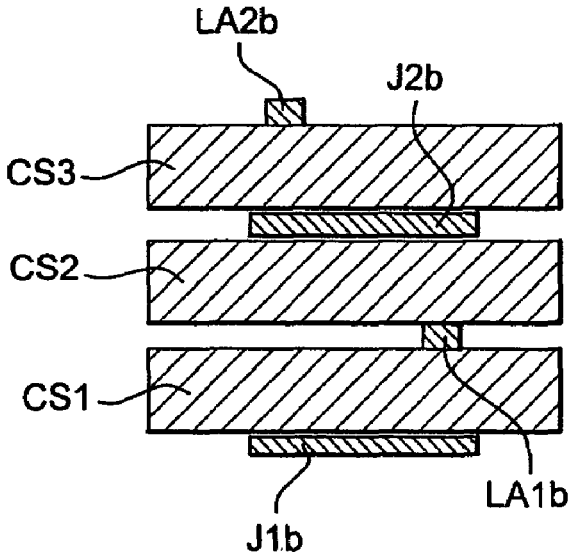
FIG. 9 is a section taken along the line IX-IX in FIG. 8.

FIGS. 8 and 9 show the second embodiment of the antenna according to the invention. The antenna is fed on separate layers. The antenna comprises a dielectric substrate third layer CS3, the second layer CS2 lying between the first and third layers CS1 and CS3. One D1*b* of the dipoles extends on the external face of one CS1 of the first and third layers, and the other dipole extends between the other two layers CS2 and CS3. The feeder line LA1*b* relating to the first dipole D1*b* extends between said one layer CS1 of the first and third layers CS1 and CS3 and the intermediate second layer CS2, over the stem J1*b* of the dipole D1*b* and under the stem J2*b* of the dipole D2*b*, and the feeder line LA2*b* relating to the other dipole D2*b* extends on the external face of the other layer CS3 of the first and third layers, over the stems J1*b* and J2*b* of the dipoles D1*b* and D2*b*. The feeder line LA2*b* is printed using the microstrip technology whereas the feeder line LA1*b* is printed using the triplate technology.

The second embodiment offers more decoupling between the dipoles D1*b* and D2*b* but at the cost of a thicker antenna compared to the first embodiment shown in FIGS. 1 and 2.

Alternatively, the conductive element of the dipole D1*b* and the feeder line LA1*b* are interchanged, the conductive element of the dipole D1*b* being situated between the layers CS1 and CS2 and the feeder line LA1*b* being situated under the layer CS1, on the outside of the stack of layers, and/or the conductive element of the dipole D2*b* and the feeder line LA2*b* are interchanged, the feeder line LA2*b* being situated between the layers CS3 and CS2 and the conductive element of the dipole D2*b* being situated on the layer CS3, on the outside of the stack of layers.

Figure 10:
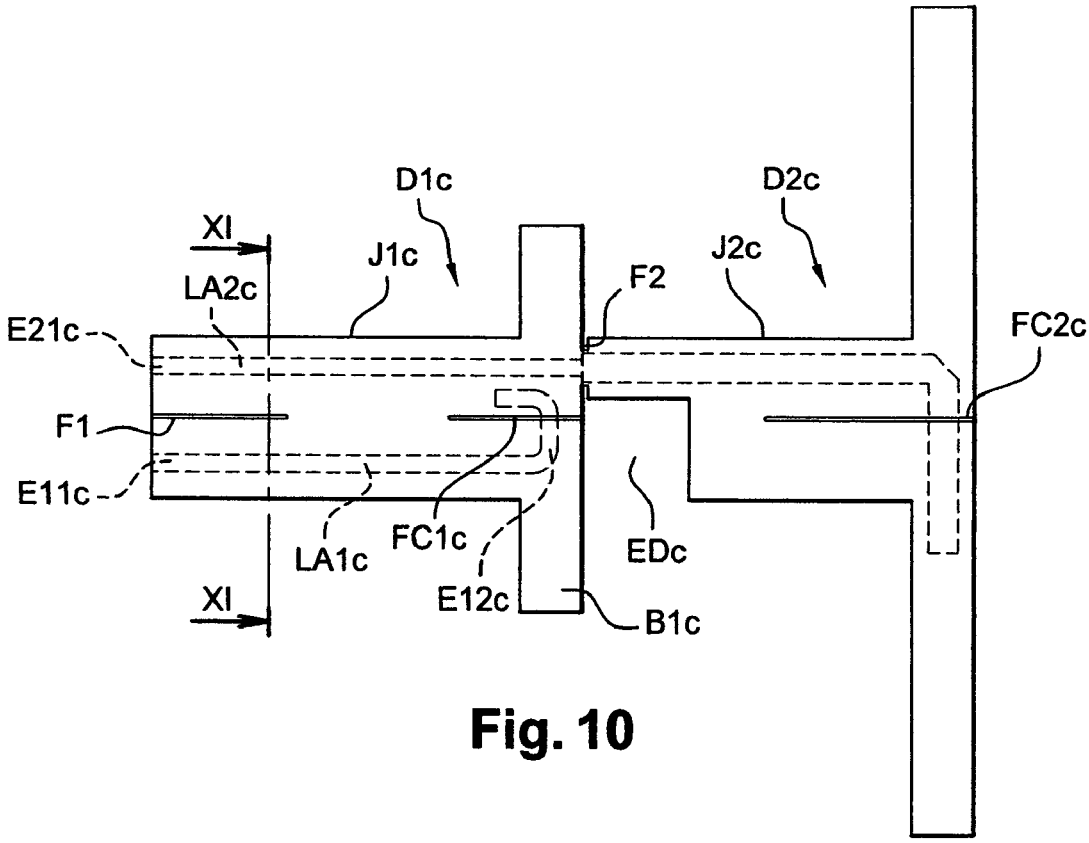
FIG. 10 is a plan view of the antenna on a single-layer substrate according to a third embodiment of the invention.
Figure 11:
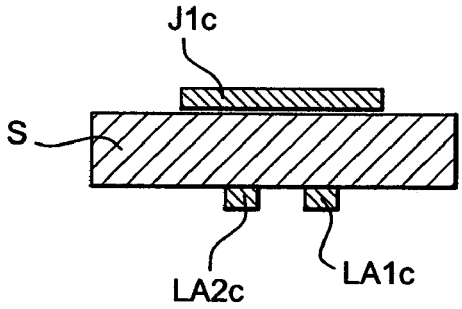
FIG. 11 is a section taken along the line XI-XI in FIG. 10.

FIGS. 10 and 11 show the third embodiment of the single-layer dielectric microstrip structure antenna according to the invention. The two printed dipoles D1*c* and D2*c* are etched on the same face of a single substrate S and the feeder lines LA1*c* and LA2*c* are etched on the other face of the single substrate S. The stem J1*c* of the smaller dipole D1*c* also serves as an end portion of the stem J2*c* of the larger dipole D2*c* so that the stems J1*c* and J2*c* are coaxial and the bases of the stems J1*c* and J2*c* are coincident at the access ends E11*c* and E21*c* of the feeder lines LA1*c* and LA2*c*.

The decoupling cut-out EDc, which can again be rectangular, is made in the edge of the stem J2*c* of the second dipole D2*c* in front of the arm B1 at the line end E12*c* and situated between that arm B1 and the far side of the coupling slot FC2*c*. The far side of the cut-out EDc is set back relative to the aligned slots FC1*c* and FC2*c* in order for the coupling slot FC1*c* of the first dipole D1*c* to open into the cut-out EDc and for the first dipole D1*c* to be able to radiate.

To accentuate the decoupling between the two dipoles D1*c* and D2*c*, an axial second coupling slot F1 analogous to the first slot FC1*c* is made in the base of the stem J1*c* opposite the first slot FC1*c* and colinearly therewith, and two slots F2 are formed at the end of a stem portion J2*c* of the dipole D2*c* situated in front of the arm B1 under which the feeder line LA1*c* and LA2*c* pass to narrow the stem J2*c* in a corner of the cut-out EDc to the width of the feeder line LA2*c* above the latter.

Figure 12:
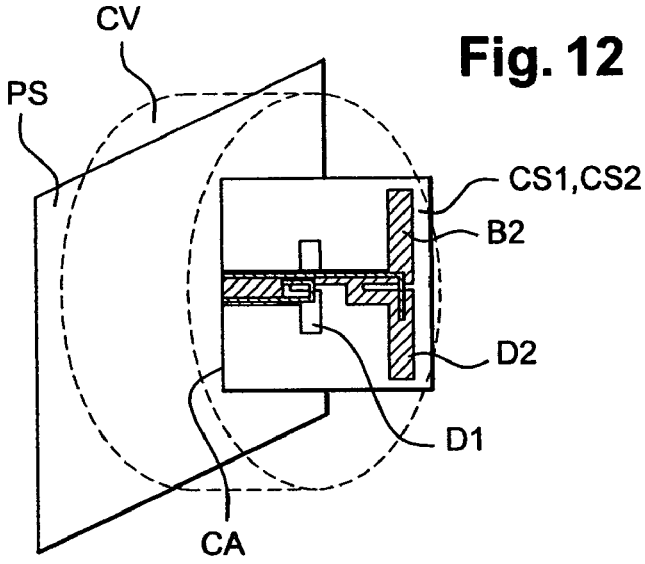
FIG. 12 is a diagrammatic perspective view of the antenna with a metallic plane according to a variant of the first embodiment.

FIG. 12 shows a variant comprising a metallic ground plane PS perpendicular to the faces of the substrate divided into one, two or three layers and therefore to the plane conductive dipoles. It is assumed in FIG. 12 that the antenna conforms to the first embodiment shown in FIG. 1. The ground plane PS serves as reflecting means to eliminate radiation from the rear of the dipoles and to direct the radiation from the front of the dipoles away from the ground plane PS, in the axial direction of the open end of the coupling slots FC1 and FC2. The ground plane PS increases the directivity of the antenna by around 2 dB at the same time as preserving the wideband performance of the antenna.

To this end, the larger arms B2 of the antenna radiating at the lowest frequencies are the farthest from the ground plane PS. The ground plane PS is typically situated at a distance from the rear access side CA of the antenna that is about one third of the wavelength corresponding to the highest frequency in the operating band of the antenna and thus the frequency band BF1 of the smaller dipole.

Alternatively, the antenna is introduced into a metallic cavity CV or a waveguide, as represented in dashed outline in FIG. 12, in order to obtain a frequency duplex feeder system in a guided structure.

The radio-frequency performance of the two-band printed dipole antenna described hereinabove is preserved if a plurality of two-band printed dipole antennas according to the invention are juxtaposed to form an array for frequency bands BF1 and BF2.

Figure 13:
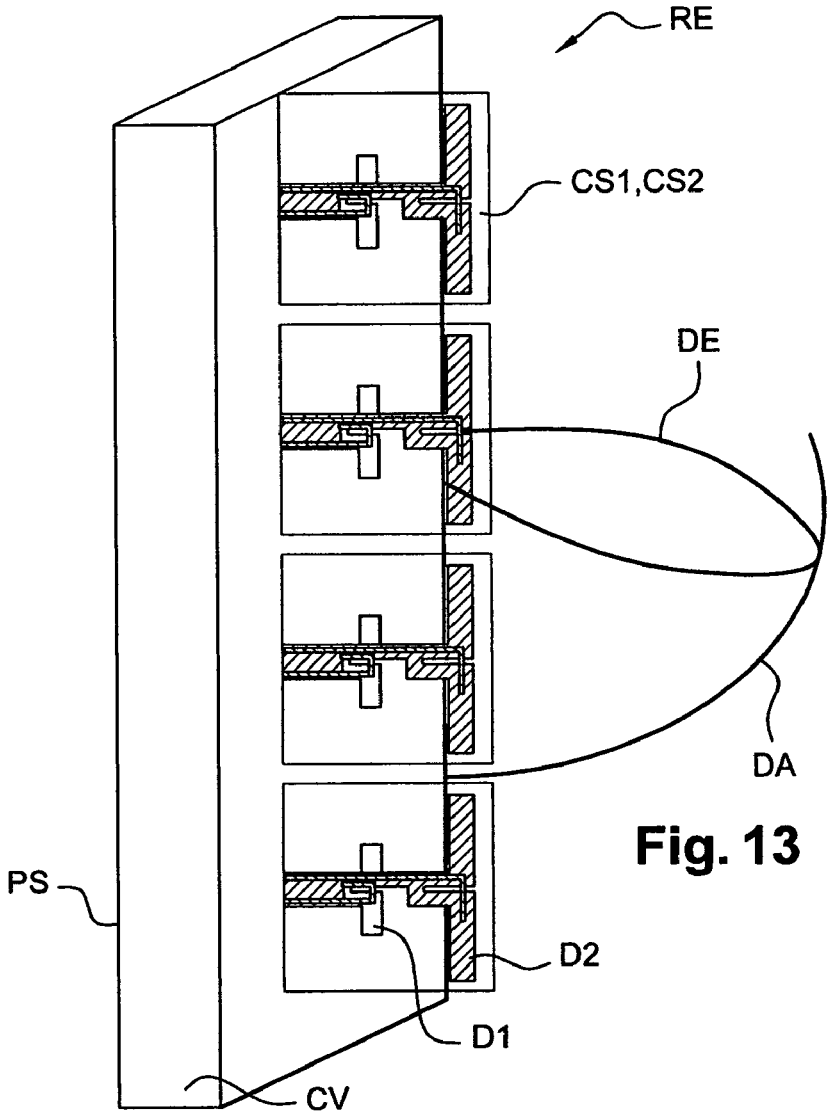
FIG. 13 is a diagrammatic perspective view of a one-dimensional array of two-band printed dipole antennas according to the first embodiment of the invention.

FIG. 13 shows one example of a one-dimensional array RE of two-band printed dipole antennas according to the first embodiment of the invention. The array comprises a column of two-band printed dipole antennas the substrate faces whereof are parallel to each other and preferably coplanar and the axial planes P of the coupling slots FC1, FC2 of the dipoles are oriented in parallel. In practice, to reduce the fabrication cost of the array, the antennas preferably have common substrate layers perpendicular to a metallic ground plane PS that can be the bottom of a cavity CV. The feeder lines LA1 of the dipoles D1 of all the antennas are connected at a common first access end and the feeder lines LA2 of the dipoles D2 of all the antennas are connected at a common second access end. The common first and second access ends can be connected to each other.

This array can constitute an antenna for a base station for GSM, DCS and UMTS radio communication networks, for example, and a station for a WLAN (IEEE 802.xx) network. Depending on the orientation of the antenna, it has a directional diagram in elevation DE and a wide diagram in azimuth DA for both frequency bands BF1 and BF2.

Alternatively, an array of antennas (not shown) with double polarization and two frequency bands consists of a first column of first two-band printed dipole antennas that are oriented in the same way as in FIG. 13 and a second column of second two-band printed dipole antennas that are oriented in the same way and perpendicularly to the orientation of the first antennas. The dipoles D1 and D2 of the first column radiate an electric field that is polarized and crosses perpendicularly the electric field radiated by the dipoles D1 and D2, respectively, of the second column for operation in the common first frequency band BF1 and the common second frequency band BF2, respectively.

The dual polarization and therefore two-dimensional array can comprise a plurality of parallel columns alternating on a plane.

Although the invention has been described with reference to two-band operation, the antenna according to the invention can be extended to a multiband structure by introducing the same number of levels of dipoles as required operating bands and the same number of dielectric layers as required operating bands for the first embodiment, the same number of pairs of dielectric layers as required operating bands for the second embodiment, or the same number of dipoles as required operating bands for the third embodiment. It is then necessary for one or more decoupling cut-outs to be made in the stems of the dipoles of the higher levels in order for them not to cover the coupling slots of the dipoles of lower levels.

While in accordance with the provisions of the Patent Statutes the preferred forms and embodiments of the invention have been illustrated and described, it will be apparent to those skilled in the art that changes may be made without deviating from the invention described above.

What is claimed is:

1. A printed antenna comprising first and second dipoles supported by a dielectric substrate, each of said dipoles having a T-shaped conductive element including a stem and two radiating arms separated by a coupling slot made in said stem, and a feeder line, the stem and the arms of a second dipole being respectively longer than said stem and said arms of said first dipole, said stem of said first dipole and a base of said stem of said second dipole being superimposed, the coupling slots being aligned, a decoupling cut-out being made in said stem of said second dipole, and the coupling slot of said first dipole opens into said decoupling cut-out by superposition.

2. An antenna according to claim 1, wherein said decoupling cut-out completely uncovers by superposition said coupling slot of said first dipole.

3. An antenna according to claim 1, wherein said dielectric substrate comprises two dielectric layers and the feeder lines of said dipoles extend between facing faces of said two dielectric layers.

4. An antenna according to claim 1, wherein said dielectric substrate comprises for each dipole a dielectric layer having faces respectively supporting the feeder line and the conductive element of said each dipole, and a dielectric layer extending between the layers supporting said dipoles.

5. An antenna according to claim 1, wherein the conductive elements of said dipoles extend on a common face of said dielectric substrate, said stem of said first dipole and said base of said stem of said second dipole being coincident, and said feeder lines extend on the other face of said dielectric substrate.

6. An antenna according to claim 1, wherein said decoupling cut-out made in said second dipole has a far side substantially aligned with said coupling slot of said first dipole.

7. An antenna according to claim 1, wherein the feeder line of said first dipole has an end bent in a U-shape toward the feeder line of said second dipole, said bent end having a core crossing said coupling slot of said first dipole perpendicularly by superposition and a short terminal branch substantially parallel to said coupling slot of said first dipole.

8. An antenna according to claim 1, wherein a metallic ground plane is perpendicular to the faces of said, one of said dipoles having the arms farthest from said metallic plane operating at the lowest frequencies.

9. An array of antennas comprising a plurality of printed antennas, each antenna being supported by a dielectric substrate and comprising first and second dipoles each having a T-shaped conductive element including a stem and two radiating arms separated by a coupling slot made in said stem, and a feeder, the stem and the arms of the second dipole being respectively longer than said stem and said arms of said first dipole, in each antenna, said stem of said first dipole and a base of said stem of said second dipole being superposed, the coupling slots being aligned, and a decoupling cut-out being made in the stem of said second dipole and the coupling slot of said first dipole opens by superposition into said decoupling cut-out, and the substrates of said antennas having faces parallel to each other and the coupling slots of said dipoles being oriented in a parallel manner.

* * * * *